United States Patent [19]

Henry et al.

[11] Patent Number: 4,538,661

[45] Date of Patent: Sep. 3, 1985

[54] GARAGE DOOR OPERATOR AND METHOD OF ASSEMBLING

[75] Inventors: Susanne G. Henry; Kazuo Tsunemura, both of Chicago; Kiyoshi Iha, Elk Grove Village, all of Ill.

[73] Assignee: Chamberlain Manufacturing Corporation, Elmhurst, Ill.

[21] Appl. No.: 521,752

[22] Filed: Aug. 9, 1983

[51] Int. Cl.[3] ..... E06B 9/32; E05F 15/00

[52] U.S. Cl. ..... 160/35; 160/189

[58] Field of Search ..... 160/35, 33, 188, 189, 160/190; 499/28

[56] References Cited

U.S. PATENT DOCUMENTS

| | | | |
|---|---|---|---|
| 967,856 | 8/1910 | Tappin | 160/193 X |
| 2,423,987 | 7/1947 | Lepikow | 160/35 |
| 3,155,147 | 11/1964 | Smith | 160/189 |
| 3,252,503 | 5/1966 | Jackson | 160/193 |
| 3,719,005 | 3/1973 | Carli | 160/188 |

FOREIGN PATENT DOCUMENTS

| | | | |
|---|---|---|---|
| 2425530 | 7/1979 | France | 160/133 |
| 604922 | 5/1960 | Italy | 160/133 |

*Primary Examiner*—Peter M. Caun
*Assistant Examiner*—Cherney S. Lieberman
*Attorney, Agent, or Firm*—Hill, Van Santen, Steadman & Simpson

[57] ABSTRACT

A garage door and opener which can be manufactured as separate units and shipped in pre-assembled units and which can be easily and quickly assembled and installed by one or more persons. The door and the operator are self-contained in the units and all of the wiring and apparatus including the door and rails are self-contained in the units.

11 Claims, 14 Drawing Figures

FIG.1
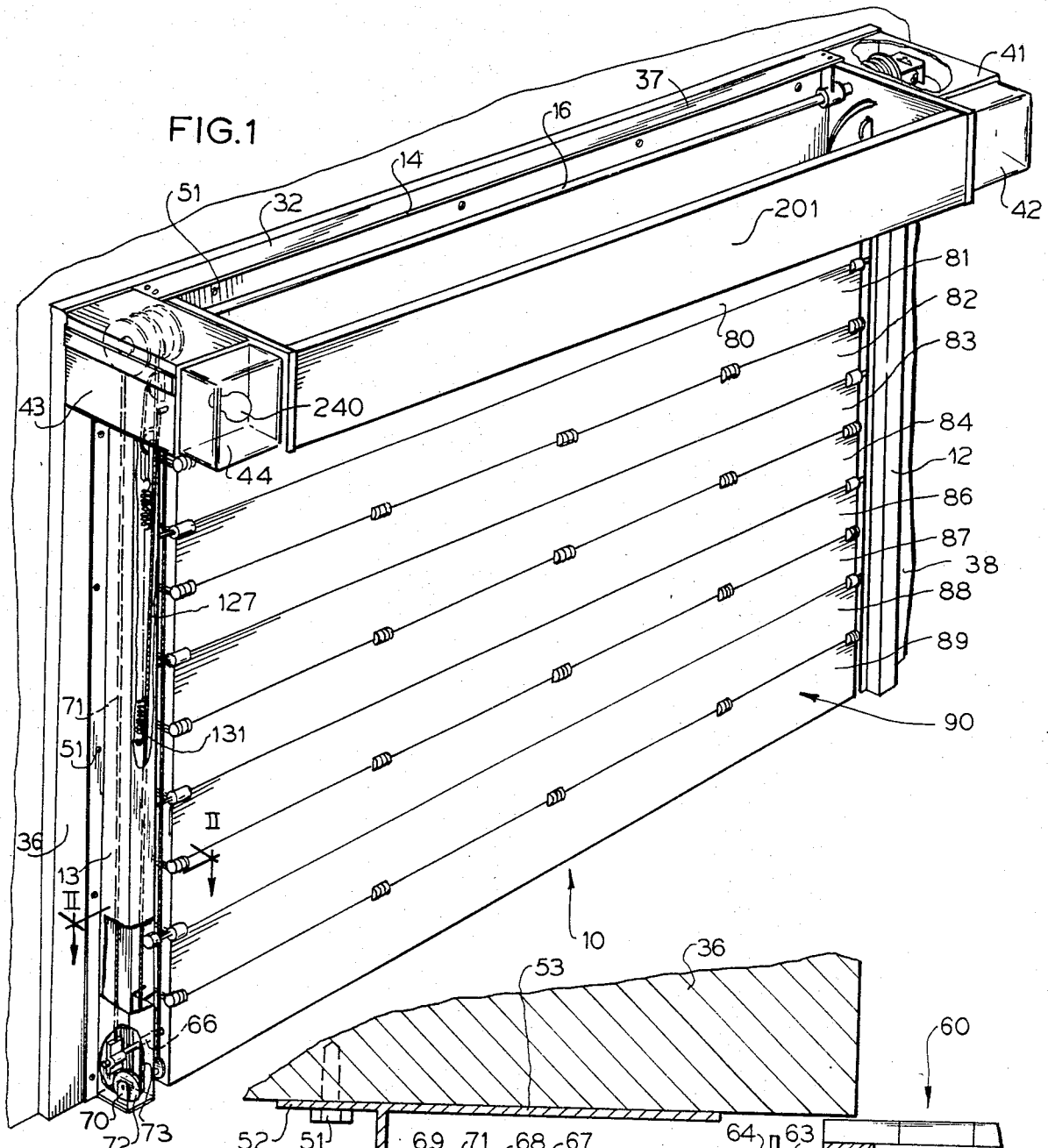
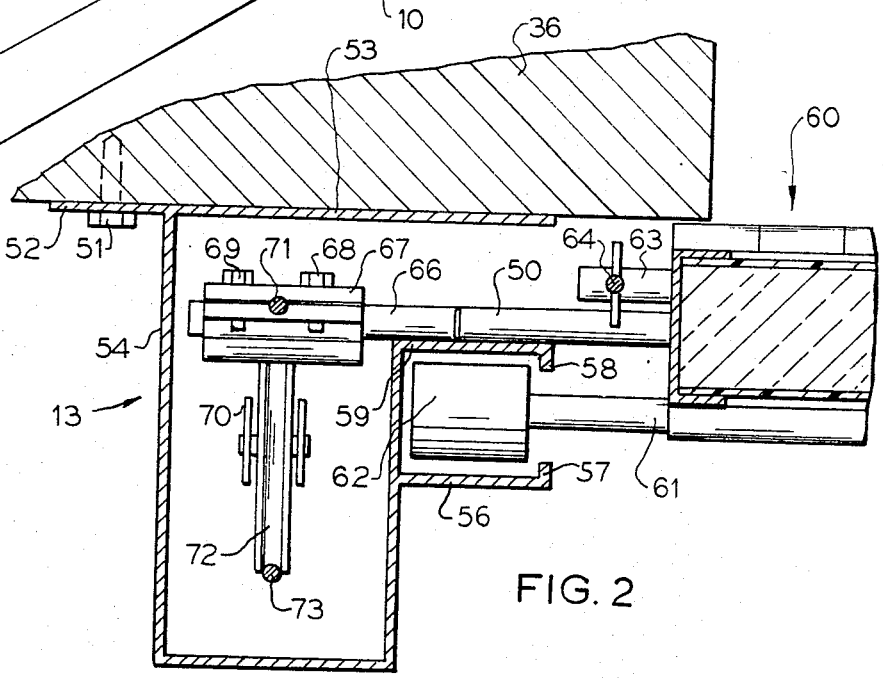
FIG. 2

FIG. 10
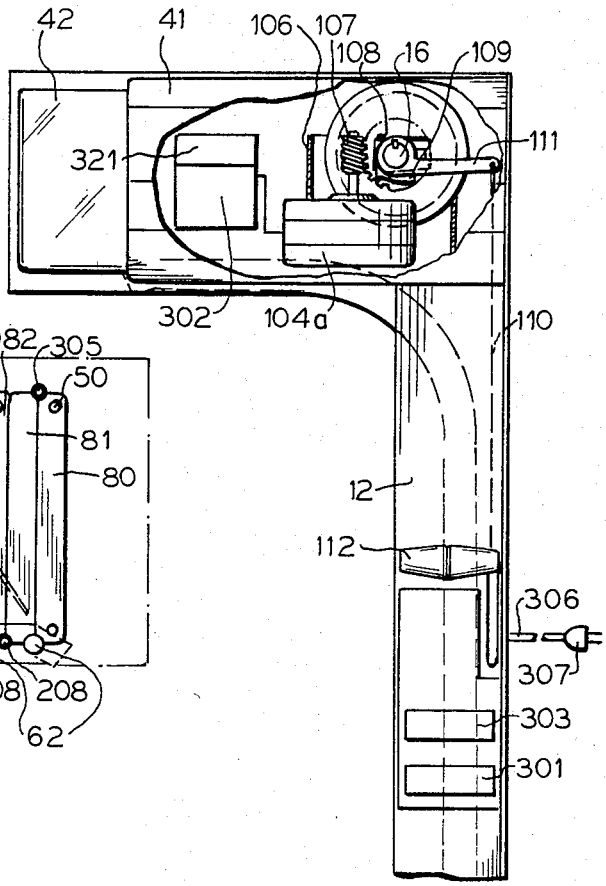
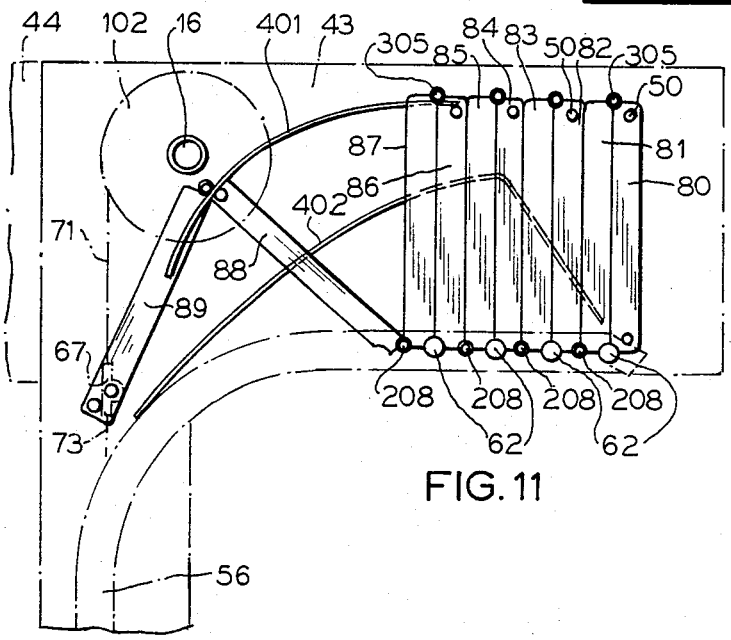
FIG. 11
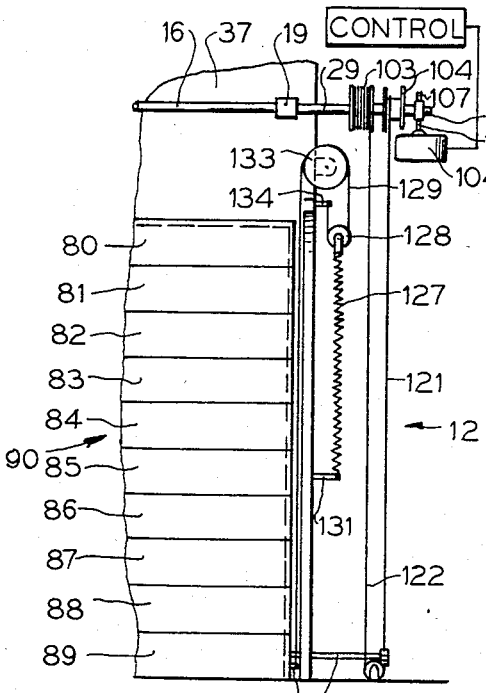
FIG. 12
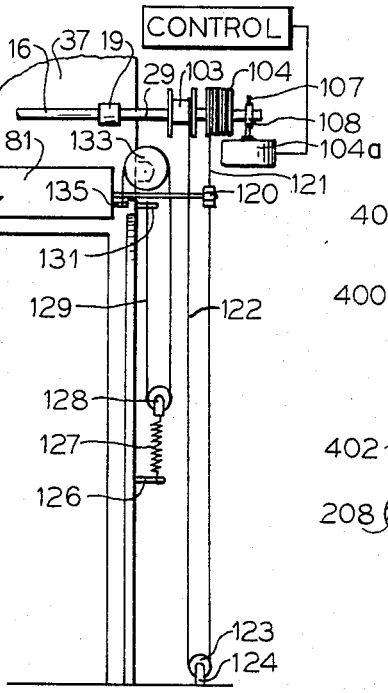
FIG. 13
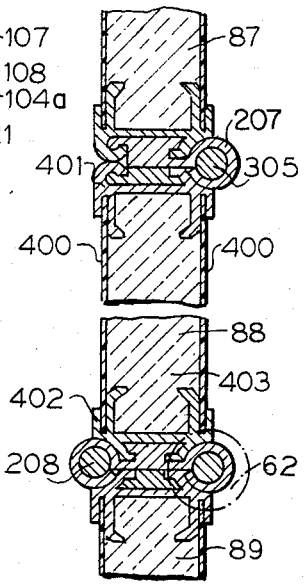
FIG. 14

GARAGE DOOR OPERATOR AND METHOD OF ASSEMBLING

CROSS-REFERENCES TO RELATED APPLICATIONS

This application is related to application Ser. No. 428,340 filed Sep. 29, 1982 entitled "INTEGRAL DEVICE FOR GARAGE DOOR OPENER" in which the inventor is Kiyoshi Iha and which is assigned to the assignee of the present invention and it is also related to application Ser. No. 428,328 filed Sep. 29, 1982 entitled "COLLAPSIBLE GARAGE DOOR" now U.S. Pat. No. 4,460,030 which issued on July 17, 1984 in which the inventors are Kazuo Tsunemura, Kiyoshi Iha and Anthony T. Janiszewski which is assigned to the assignee of the present application.

BACKGROUND OF THE INVENTION

1. Field of the Invention

The present invention relates to garage door openers and in particular to a novel garage door opener which can be shipped in units and easily and simply assembled and installed.

2. Description of the Prior Art

The present garage door openers are sold as units which are to be connected to garage or other doors which are separately manufactured and installed. Such garage doors are very heavy which makes them difficult to open and are very expensive. Certain of the doors are too light and have poor insulation and security. The garage doors are mounted with steel hardware on rails and are difficult to assemble and are noisy to install. The garage doors require substantial space in the ceiling above the door when in the opened position.

Present day garage doors and openers require frequent maintenance, painting, spring adjustment and lubrication. Also, the present garage door openers are unsafe as, for example, when a spring fails which causes the door to fall and also the emergency release may be inaccessible which could result in injury to personnel. Present day garage door openers are normally installed after the door has been installed and, thus, a two step installation is required where first the garage door is mounted and then subsequently the garage door opener is connected to the garage door to actuate it. Such installations require additional wiring of the receiver and switches and each installation is different and, thus, the obstruction reversing forces, the limit switches at the top and bottom and the other parameters for the door and the opener are different for each installation.

This results in dangerous situations in that the installation may be improperly connected and also the various adJustments may be improperly made resulting in injury and even death to personnel. For example, in garage door openers of the prior art, since each door has different weight and requires different pull-down and pull-up force it is necessary to have a motor which is larger than would be required for other doors and garage door openers. This leads to excessive speeds and forces which can be applied to the garage door which can result in injury. Also, since the weight of each door varies, the obstruction detecting force is made adJustable by either the installer or the home owner and if such adjustment is made to be too tight, the door may not reverse if it encounters a child, for example, and this has resulted in the death of children.

SUMMARY OF THE INVENTION

The present invention comprises a fully integrated automatic garage door wherein the door with its guide rails and the door operator and controls are constructed at the factory and shipped in modular units such that it can be easily installed by the home owner or installers and which does not have any adjustments which are to be made by the home owner or the installer. Such adjustments can be made at the factory and, thus, each installation will be properly adjusted substantially improving the safety of such units.

The garage door opener is shipped to the installation site with two side frame units and a spreader frame unit with a drive shaft which can be detachably connected to the side unit at the location where the door is to be installed. The door comprises thermal core panels which are light weight have improved insulation and provide improved security.

The installation is simple and quick. The unit results in improved appearance over prior art doors and operators and there are no external units which are attached to the structure.

A compact folding stacking door is provided so that the minimum space is utilized and the unit is maintenance free and has long life.

The garage door and operator is designed to have maximum safety in that the preset forces are set at the factory and cannot be adjusted by the home owner or installer so as to render the unit dangerous. Failure of the spring will not cause the door to fall and there is an easily accessible emergency release if it is desired to disconnect the door from the opener unit.

The unit is convenient and compact in that the garage door opener is integrally formed with the garage door and its mechanism.

The various electrical wiring for the accessories and built-in features such as the lights are pre-wired and no extra wiring is required for the unit. The efficiency of the operator is optimized and the units are completely self-contained.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure and in which:

BRIEF DESCRIPTION OF THE DRAWINGS

FIG. 1 is a perspective view of the garage door and operator installed;

FIG. 2 is a partial top sectional view illustrating the invention;

FIG. 10 is a partially cut-away end view of the invention;

FIG. 10A illustrates the clutch

FIG. 11 illustrates the door in the upper stored position;

FIG. 12 llustrates the cable mechanism;

FIG. 13 illustrates the cable mechanism with the door in the opened position; and FIG. 14 is a sectional view through the door panels.

DESCRIPTION OF THE PREFERRED EMBODIMENTS

FIG. 1 illustrates the garage door and opener of the invention installed to cover the opening of a garage. Side headers 36 and 38 are mounted vertically on the sides of the door opening and a top header 37 is mounted to the structure at the top of the door opening. The garage door and opener 10 is connected to the headers 36, 37 and 38.

Figure 3:
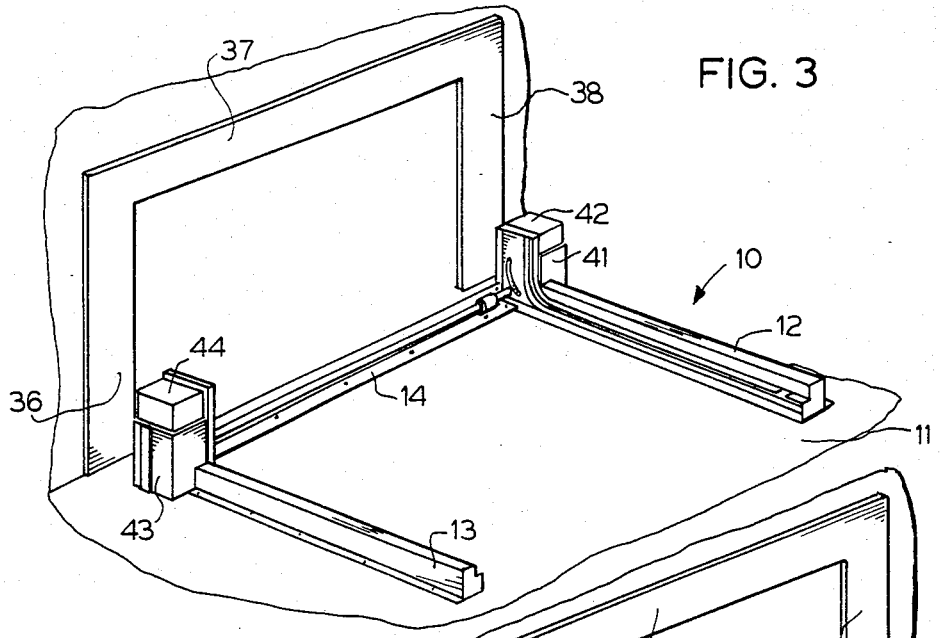
FIG. 3 is a perspective view illustrating the method of assembling the garage door and opener.
Figure 7:
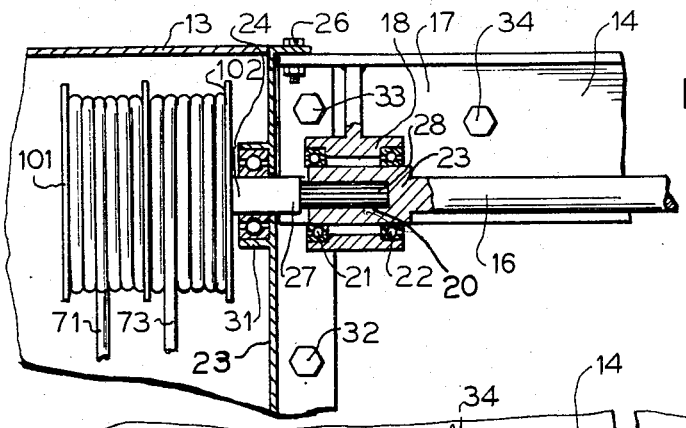
FIG. 7 is a sectional view illustrating the drive shaft and the cables for the left side of the door.
Figure 8:
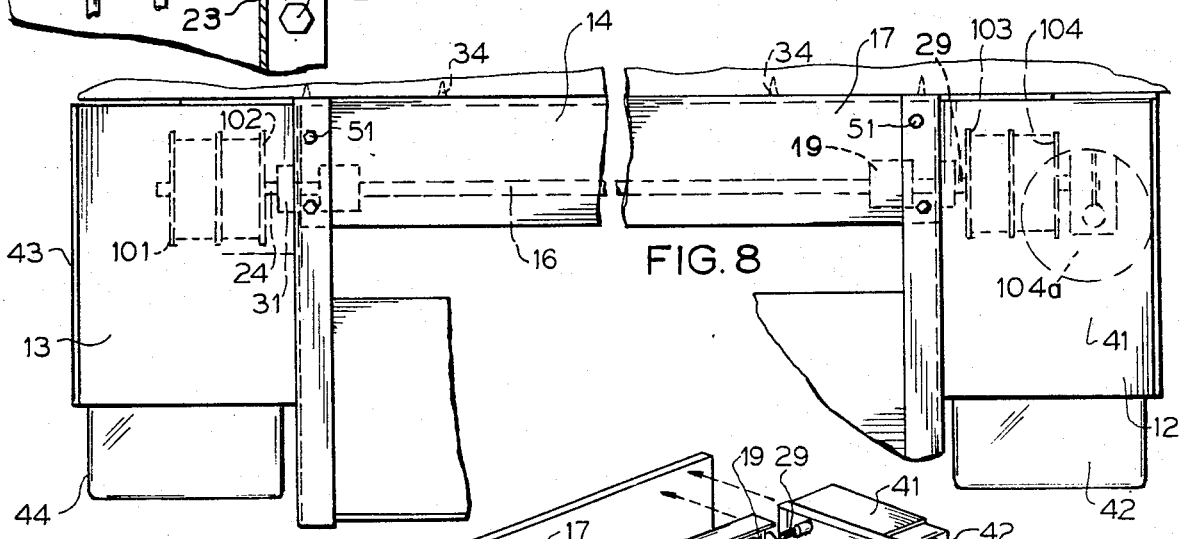
FIG. 8 is a top view illustrating the mechanism.
Figure 9:
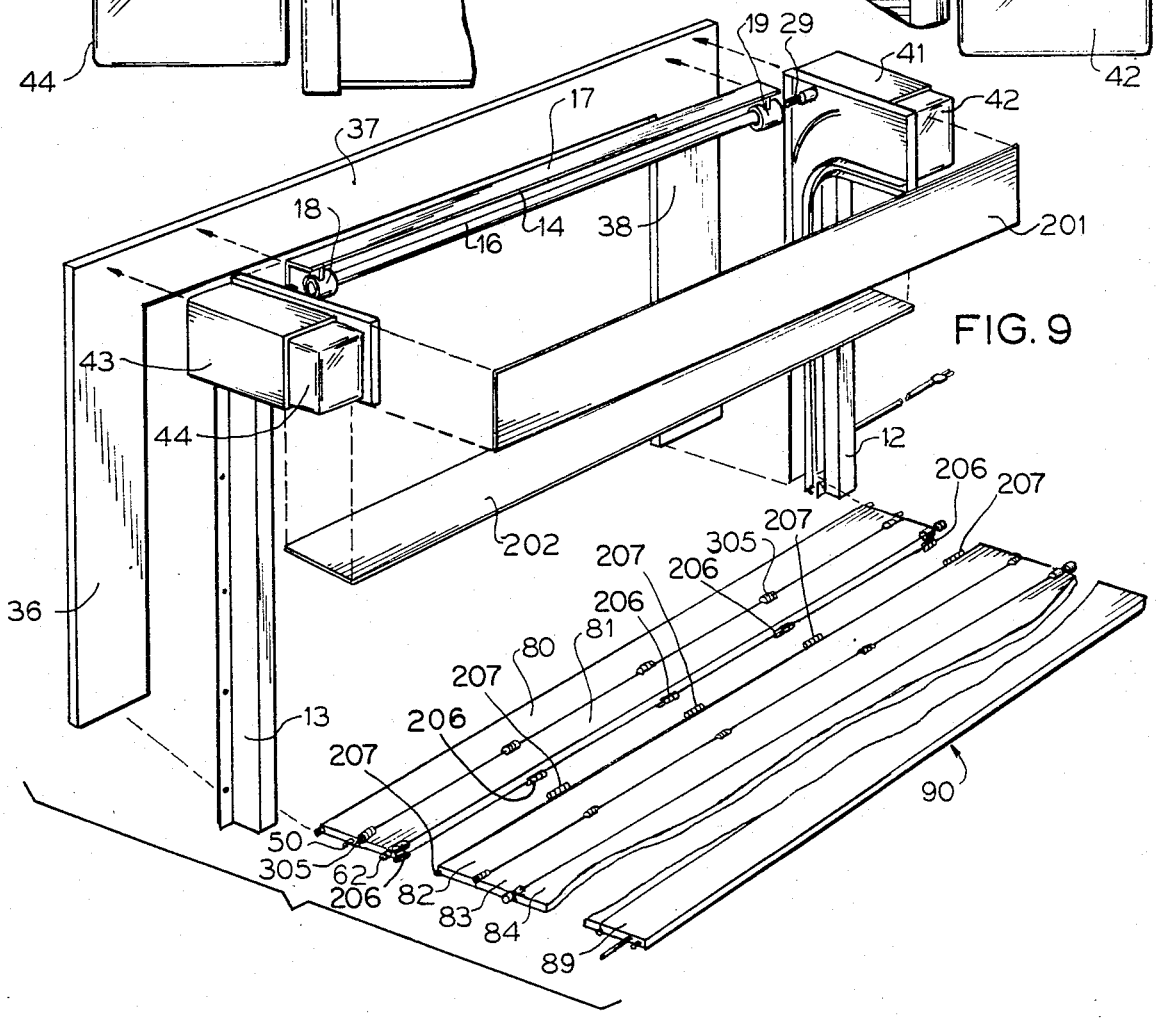
FIG. 9 is a perspective exploded view illustrating the invention.

A pair of side cable drive frame assemblies 12 and 13 are connected by a spreader frame unit 14 which includes a drive shaft 16 and the members 12, 13 and 14 are shipped unassembled and can be conveniently and uniformly packaged for shipping. When the door and opener is to be assembled, the cable drive frame assemblies 12 and 13 are laid out on the floor as illustrated in FIG. 3 and the spreader frame unit 14 is connected to the cable drive frame assemblies 12 and 13 as shown, for example, in FIG. 7. The drive shaft 16 is rotatably supported at either end by bearings such as 21 and 22 illustrated in FIG. 7 which are supported by a bracket 18 connected to an angle iron 17 that extends the width of the spreader frame unit 14. The cable drive assembly frame unit 13 has a side wall 25 that supports a bearing 31 which carries a shaft 24 upon which cable reels 101 and 102 are supported. The reel 101 carries a cable 71 and the reel 102 carries a cable 73. The external end 28 of shaft 24 is splined and is received in a splined female opening 20 on the end of shaft 16 with a slide fit so that the frame units can be coupled together so that shaft 16 will turn the reels 101 and 102 when they are assembled. Bolts 26 connect the angle iron 17 to the cable drive frame assembly 13. As illustrated in FIGS. 8 and 9, the cable drive frame assembly 12 also has a splined shaft 29 which carries reels 103 and 104 and which is received in a splined end of shaft 16 within bracket 19 which is supported from the angle iron 17 as illustrated in FIG. 9. Bolts also attach angle iron 17 to the cable drive frame assembly 12. A motor 104*a* is mounted in cable drive frame assembly 12 as shown in FIGS. 10, 12 and 13 and drives shaft 29 through a worm 107 mounted on the output shaft of the motor which engages a gear 108 mounted on shaft 29. An emergency release clutch 109 is illustrated in FIG. 10 and is mounted between the gear 107 and the shaft 29 and a lever 111 is connected to the clutch 109. A linkage such as a table 110 extends from the clutch lever 111 to an emergency release handle 112 mounted on the side of the cable drive frame assembly 12 as illustrated in FIG. 10 so that the motor can be disconnected from drive shafts 29 and 16 at any time either to stop the motor drive or alternatively to allow manual opening and closing of the door 90. FIG. 10*a* illustrates the clutch in greater detail.

Figure 4:
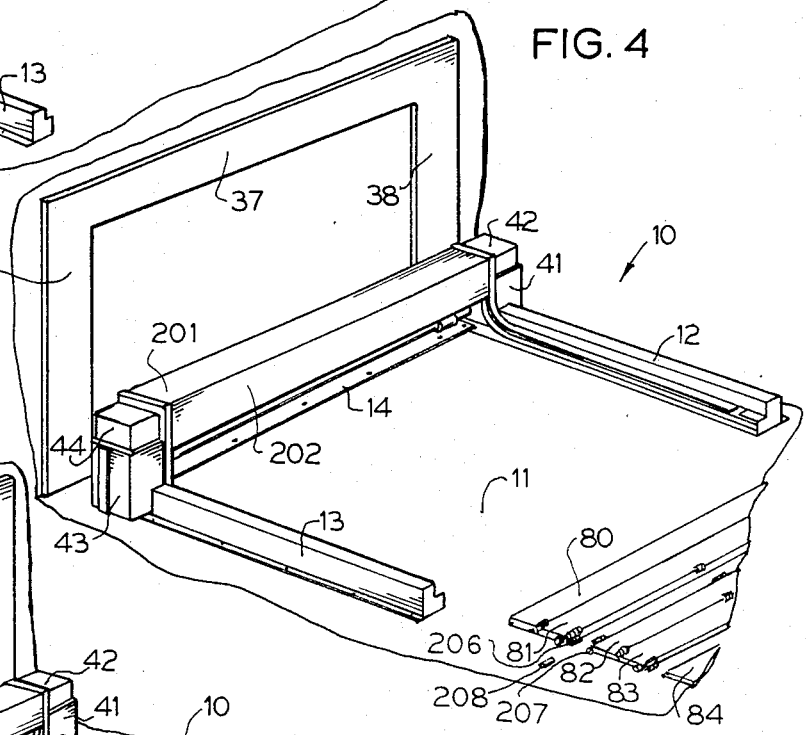
FIG. 4 is another perspective view illustrating the door and operator being assembled.

FIG. 4 illustrates the cable drive frame assemblies 12 and 13 after they have been attached to the spreader drive frame shaft unit 14 and a front valance panel 201 and a bottom valance panel 202 have been connected to the cable drive frame assemblies 12 and 13 so as to cover the drive shaft 14 and the angle iron 17 of the spreader frame unit 13.

The garage door 90 is formed of a plurality of door panels 80 through 84*a* and 86 through 89. As illustrated in FIG. 4, the door panels come pre-assembled in pairs and may be of the form of the panels illustrated in application Ser. No. 428,328 wherein each of the pairs are hinged to each other so as to fold in a first direction. Each of the cable drive assembly frame members 12 and 13 are formed with rails as, for example, the rail 56 illustrated in FIG. 2 for the cable drive assembly frame unit 13 into which rollers 62 mounted on shaft 61 can be received and which are attached to the panels 80 through 89. Other pins 50 extend from the panels 80 through 89 and ride on the outer surface of the rail 56 as illustrated in FIG. 2. The roller 62 can be received in the end of the rail 56 and proJections 57 and 58 which prevent the rollers 62 from pulling out of the rail 56.

Figure 5:
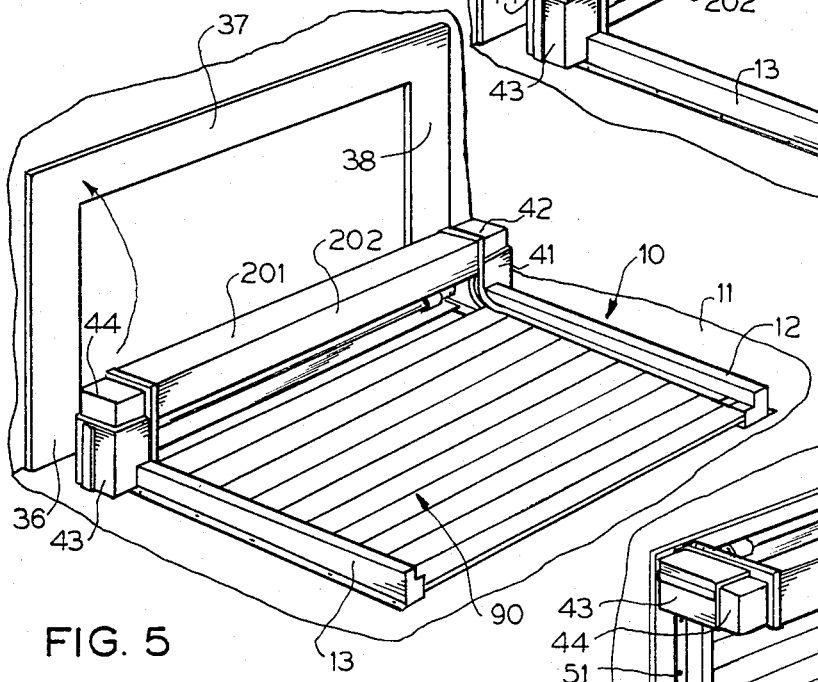
FIG. 5 illustrates the door and opener mechanism assembled before attaching it to the door opening.
Figure 6:
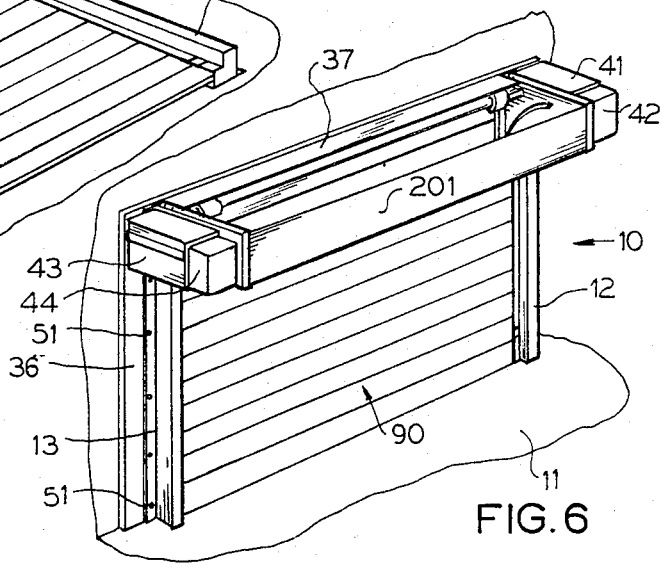
FIG. 6 is a perspective view illustrating the door and opener attached to the door opening.

A first pair of panels 80 and 81 are inserted into the frame members 12 and 13 with the roller 62 in rail 56, then the next pair of panels 82 and 83 are inserted with the rollers 62 into the rail 56 and the panels 81 and 82 are connected together at hinges 206 and 207 by inserting pins 208. Then the next pair of panels 84 and 85 are inserted into the frame units 12 and 13 and are connected by the hinges on the panel 83 until the entire door is assembled as illustrated in FIG. 5. After the door has been assembled, it is tilted upwardly to the vertical position illustrated in FIG. 6 and bolts 51 are utilized to connect the units 12, 13 and 14 to the headers 36, 37 and 38. For example, FIG. 2 illustrates a bolt 51 which passes through a flange 52 which is an extension of the planar member 53 of the cable drive assembly 13.

As shown in FIGS. 1 and 2, the lower panel 89 has an extension shaft 66 which is received within the confines of the cable drive assembly 13 which has side wall 54 and which carries a bracket 67 that can be clamped by bolts 68 and 69 to the drive cable 71. The drive cable 71 passes up to the drive pulley 101 as illustrated in FIG. 7. The drive cable 73 passes down through the confines of the cable drive frame assembly 13 and around the pulley 72 which is mounted by brackets 70 to the lower end of cable drive frame assembly 13. The cable 73 also attaches to the bracket 67. A counter balance spring 127 has one end attached to frame member 13 by bracket 131 as illustrated in FIG. 1 and in FIGS. 12 and 13. The upper end of spring 127 is connected to a pulley 128 and a cable 129 has one end connected to a bracket 134 connected to the frame member 12 as illustrated in FIGS. 12 and 13. A pulley 133 is also rotatably supported adjacent the top of member 12 and cable 129 passes over the pulleys 128 and 133 and is attached to the lower panel 89 of the door 90 with a suitable bracket 135. It is to be realized that both of the frame units 12 and 13 include cable drives and counter balance springs 127 and the left counter balance spring is illustrated in FIG. 1 and the right counter balance spring structure is illustrated in FIGS. 12 and 13. As shown in FIGS. 12 and 13 the cable 122 passes from pulley 103 around pulley 123 which is rotatablty supported by bracket 124 which is attached to the floor. Bracket 120 is attached to door panel 89 and to cable 122. Cable 121 passes from pulley 104 to bracket 120.

The upper ends of cable drive assembly frame members 12 and 13 have enlarged portions 41 and 43 respectively, and light covers 42 and 44 are attached to the enlarged portions 41 and 43 and lights 240 are mounted therein.

FIG. 11 is similar to FIG. 5 in application Ser. No. 428,328 which description is incorporated by reference and illustrates how the panels 80 through 89 fold up accordian-wise in the upper portions of 41 and 43 of the cable drive assembly frame units 12 and 13. FIG. 14 is a sectional view through panels 89, 88 and 87 after they have been assembled together. FIG. 14 is the same as FIG. 2 in U.S. application Ser. No. 428,328 now U.S. Pat. No. 4,460,030 the description from this application is hereby incorporated by reference.

FIG. 11 shows the door 90 in the folded or up position. Guides 401 and 402 and the rail 56 engage the rollers 62 and pins 50 to cause the panels to store as shown in FIG. 5 of Ser. No. 428,328. The hinges 206 and 207 are connected by pins 208. Hinges 305 join the panels also as shown.

FIG. 14 is a sectional view through three panels such as 87, 88 and 89. The panels are made of aluminum walls 400 which are received in extrusions 401 and 402 and are filled with styrofoam 403.

FIG. 10 illustrates a control unit 302 which is mounted in portion 41 of frame member 12 and a door actuating switch 301 is connected to the control 302 to energize the garage door opener. When this occurs the motor 104*a* is energized to either open or close the door in a conventional manner by driving shaft 16 to drive the reels 101, 102, 103, 104. The control unit 302 also includes a radio receiver which is connected to energize the motor 104*a* when energized by a remote transmitter not shown. This allows the garage door opener to be actuated remotely as, for example, by the driver of an automobile who desires to open or close the garage door. A light switch 303 is connected to the control 302 so as to allow the lights 240 within the light cover panels 42 and 44 to be energized manually. It is to be realized that the lights also turn on automatically when the garage door opener is energized to either open or close the door but the switch 303 also allows the lights to be turned on manually when desired.

The emergency release pull handle 112 actuates the clutch 109 by moving the lever 111 which disconnects the motor 104*a* from the shafts 29 and 16 thus allowing the door to be manually moved upwardly or downwardly under emergency conditions as when power is not available due to power failure or for other reasons. The clutch 109 disconnects the shaft 29 from shaft 16 when the lever 111 is pulled down by the handle 112 and cord 110. A similar clutch arrangement is shown in U.S. Pat. No. 4,472,910.

A power cord 306 has a plug 307 which can be connected to a suitable power outlet and merely inserting the plug 307 in the power outlet completes the wiring required for installation of the garage door and the garage door opener.

The setting of the tensions on the obstruction detecting is in a unit 321 of the control 302 and this is not readily available to the home owner or the installer since it is within the sealed control unit 302 and this adjustment is made at the factory. This can be done since the weight of the door 90 is known at the factory and this can be set to points wherein an installer or the home owner cannot make this adjustment such that it is too tight which would render the garage door opener dangerous. In other words, this is a factory setting and once set cannot be changed by the installer or home owner and, thus, the obstruction detecting mechanism will not be adjusted to a dangerous setting as can occur with prior art devices.

It is seen that this invention provides a new and novel garage door opener and although it has been described with respect to preferred embodiments, it is not to be so limited as changes and modifications can be made therein which are within the full intended scope as defined by the appended claims.

We claim as our invention:

1. A garage door and opener formed in modular units formed for mounting over an opening comprising, a pair of side drive frame assemblies including door supporting rails and driving means mounted therein, a spreader frame unit in which a drive shaft is rotatably mounted which is detachably connected to said door driving means mounted in said pair of side drive frame assemblies, a drive means mounted in one of said drive frame assemblies and coupled to said drive shaft to move said door driving means, means for connecting said pair of side drive frame assemblies and said spreader frame unit about said opening, and a door mounted in said supporting rails of said pair of side drive frame assemblies and connected to said door driving means, and wherein said door driving means in each of said pair of side frame assemblies include stub shafts which are detachably connectible to opposite ends of said drive shaft.

2. A garage door and opener sccording to claim 1 wherein the ends of said stub shafts are splined and are receivable in splined openings formed in the ends of said drive shaft.

3. A garage door and opener according to claim 1 the ends of said stub shafts are non-rotatably connected to opposite ends of said drive shaft.

4. A garage door and opener according to claim 1 wherein said door driving means include a pull-up reel mounted on one of said stub shafts, and a first cable connected to a lower portion of said door and to said pull-up reel.

5. A garage door and opener according to claim 4 including a second reel mounted on one of said stub shafts, a pulley mounted adjacent the lower portion of one of said side drive frame assemblies and a second cable connected to said door and passing over said pulley and connected to said second reel.

6. A garage door and opener according to claim 1 including a front cover panel attachable to pair of side drive frame assemblies.

7. A garage door and opener according to claim 1 including a bottom cover panel attachable to said pair of side drive frame assemblies.

8. A garage door and opener according to claim 1 wherein said pair of side drive frame assemblies include door storing portions at their upper ends and said door foldably receivable within said door storing portions when in the up position

9. A garage door and opener according to claim 1 including a radio receiver mounted in one of said pair of side drive frame means and connected to said door driving means to energize it.

10. A garage door and opener according to claim 9 including a light mounted in one of said pair of side drive frame means.

11. A garage door and opener according to claim 9 including a control means mounted in one of said pair of side drive means and connected to said door driving means.

* * * * *